United States Patent [19]

Meyers

[11] 4,353,612

[45] Oct. 12, 1982

[54] SHIELD CONNECTOR

[75] Inventor: Richard G. Meyers, Euclid, Ohio

[73] Assignee: The National Telephone Supply Company, Cleveland, Ohio

[21] Appl. No.: 156,932

[22] Filed: Jun. 6, 1980

[51] Int. Cl.[3] ..... H01R 4/24

[52] U.S. Cl. ..... 339/95 R; 339/14 L

[58] Field of Search ..... 339/95 R, 14 L; 174/84 C, 84 S, 88 C, 88 S

[56] References Cited

U.S. PATENT DOCUMENTS

| | | | |
|---|---|---|---|
| 3,253,297 | 5/1966 | Vos | 339/95 R |
| 3,643,006 | 2/1972 | Ance | 339/95 R X |
| 3,798,585 | 3/1974 | Thompson et al. | 339/14 L |
| 3,864,009 | 2/1975 | Wickenberg | 339/95 R |
| 3,915,540 | 10/1975 | Thompson et al. | 339/95 R |
| 3,963,299 | 6/1976 | Thompson et al. | 339/95 R |
| 4,026,619 | 5/1977 | Gillemot | 339/95 R X |
| 4,036,546 | 7/1977 | Thompson et al. | 339/95 R |

*Primary Examiner*—Eugene F. Desmond

*Attorney, Agent, or Firm*—Woodling, Krost & Rust

[57] ABSTRACT

A connector for electrically and mechanically joining a conductor to a communication cable sheath. Transversely arcuate, opposed members or arms with a row of pointed tangs on each longitudinal edge, are hingedly joined at one end. The other ends are adapted to be joined to clamp the cable sheath between the arms. At least one arm is elastic and longitudinally curved away from the other arm so that in use a compressive force is maintained even upon deformation of the cable sheath.

19 Claims, 6 Drawing Figures

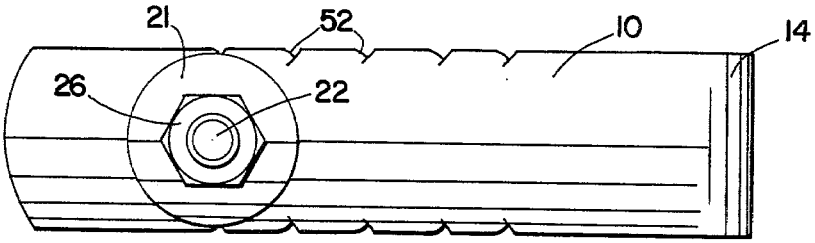
Fig. 1
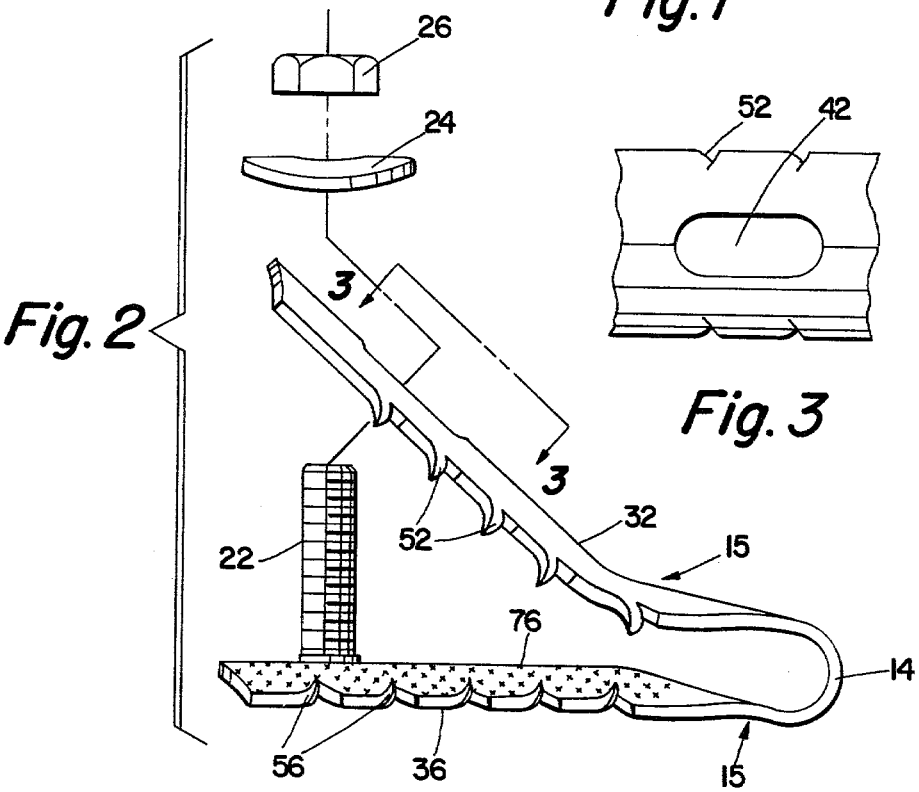
Fig. 2
Fig. 3
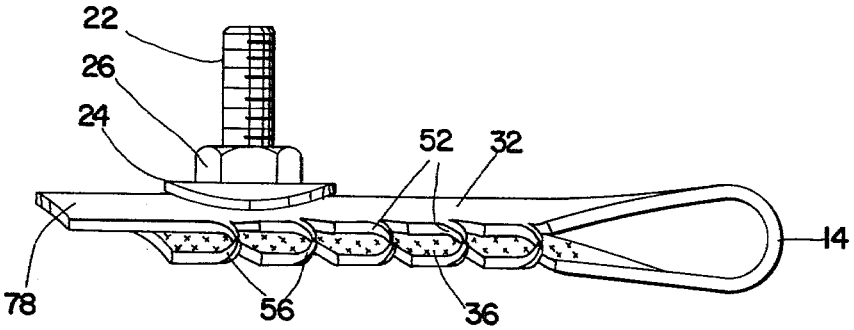
Fig. 4

SHIELD CONNECTOR

BACKGROUND OF THE INVENTION

This invention relates to electrical connectors for making an electrical connection between a conductor and the conductive shield of a communication cable.

Communication cables are constructed with a core of conductors surrounded by a protective sheath. The sheath is usually comprised of a tubular metallic shield with an outer tubular plastic jacket. Most commonly the shield is aluminum, has a thin insulating coating and is bonded to the outer jacket.

In a cable system, shield continuity and ground must be maintained for optimum performance. Thus at various points in a cable system, for example at a splice, a bonding conductor must be connected to a cable shield to provide this continuity and ground.

Because the shield is usually not separable from the jacket, a shield connector must be attached to the combined shield and jacket forming a layered structure. While a typical shield connector may make good electrical contact initially, flow of the plastic jacket can sufficiently reduce contact force between connector and shield to cause a bond failure after a few years. Efforts have been directed to improving contact force by substituting for the usual nut and bolt connector joining means a sleevelike fitting provided with annular grooves adapted to interfit with protuberances on a terminus of a connecting post. See U.S. Pat. No. 3,643,006. However in this device, as in others, for example those of U.S. Pat. Nos. 3,753,204, 3,753,213 and 4,026,619, the eventual permanent deformation of the plastic jacket with age will lead to reduction of the contact force and possibly even to loosening of the connector's mechanical bond to the cable sheath.

Some shield connectors have spring action to compensate for these changes, thereby minimizing the contact force reduction. These connectors generally fall into two categories:

(1) The cantilever types have pivoting top and bottom plates encompassing a portion of the sheath which are pulled together by a joining means external to the contact area, between the pivot and the contact area. Examples are the devices of U.S. Pat. Nos. 3,778,749 and 3,787,797.

(2) The most common types are those with a centrally located joining means pulling top and bottom plates together in the contact area. In this case the joining means passes through a hole or slit in the sheath. Examples are the devices of U.S. Pat. Nos. 3,676,836 and 3,701,839.

The first type of connector has the advantage of a potentially large "travel" in spring action. Its primary disadvantage is low initial contact force, typically one-half the tension in the joining means. The second type provides contact force approximately equal to the tension in the joining means, but it has potentially small "travel" in the spring action and therefore does not compensate for jacket plastic flow very well.

In view of these problems with existing shield connectors, design criteria for an improved shield connector might include high initial contact force together with a long "travel" spring action to compensate for jacket plastic flow.

Fault currents and lightning surge currents also have been known to cause shield bond failures or damage to the cable core conductors, so a shield bond should be highly resistant to these damaging currents. In particular the resistance of the shield bond must remain low when subjected to such currents.

Shield bond failure can also result from damage to the shield during connector installation. This can occur due to bending and weakening of the shield or simply by cutting the shield in a manner that reduces its current carrying capacity. A shield connector should not damage the cable shield during installation.

A mechanically firm bond is also an important requirement since any tendency to looseness or relative motion in the bond components can aggravate the previously mentioned failure modes.

SUMMARY OF THE INVENTION

The foregoing objects and others are achieved in accordance with the principles of this invention by the use of a connector formed of two arms or members, at least one of elastic material, with a hinged relationship at one end and a means for joining the other ends to each other and to a bonding conductor.

In the preferred embodiment, at least one of the arms is longitudinally arcuate to curve away from the other arm at the ends so that a portion of cable sheath positioned between the members and between the hinged end and the joined end is compressed between the members with a force approximately twice the tension in the joining means. Because of elastic member deformation the compressive force is substantially maintained even if the plastic jacket of the sheath deforms with aging.

Tangs or barbs comparable in projection to the cable sheath thickness, protrude from the members into the sheath thereby contacting the shield. At least the member adjacent to the cable shield and one of the joining means are conductive so that by means of the barbs, a member, the joining means and a bonding conductor can conduct shield electrical currents.

The barbed connector members firmly grip the cable sheath maintaining cable sheath integrity while providing a mechanically firm shield bond.

To further enhance the electrical connection between barbs and cable shield, the relative positioning of the barbs on opposite members, together with transverse curvature in the members, causes the barbs of one member to wedge transversely against the barbs of the other member, with the shield compressed between them.

A still further aid to connector contact with the cable shield is an embossed surface on the connector member surface adjacent the cable shield. Small but numerous edges and points are available for penetrating the thin insulating coating on the cable shield.

It is one object of this invention to provide a shield connector which maintains a high force of contact to a cable shield.

Another object of this invention is to provide a shield connector which maintains a low resistance connection to a cable shield even when the bond is subjected to fault currents, surge currents, varying temperatures, and vibration.

A further object of this invention is to provide a mechanically firm shield bond that does not physically or electrically weaken the cable sheath structure.

BRIEF DESCRIPTION OF THE DRAWINGS

The invention will be further described with reference to the accompanying drawings wherein:

FIG. 1 is a plan view of a connector according to the present invention, showing the upper or outer member and the joining means;

FIG. 2 is a side elevational view of the connector in exploded or disassembled form;

FIG. 3 is a partial plan view of the portion of the disassembled connector lying between arrows 3-3 of FIG. 2, showing the oblong hole in the upper or outer member;

FIG. 4 is a side elevational view of the connector as assembled;

DESCRIPTION OF THE PREFERRED EMBODIMENT

Figure 5:
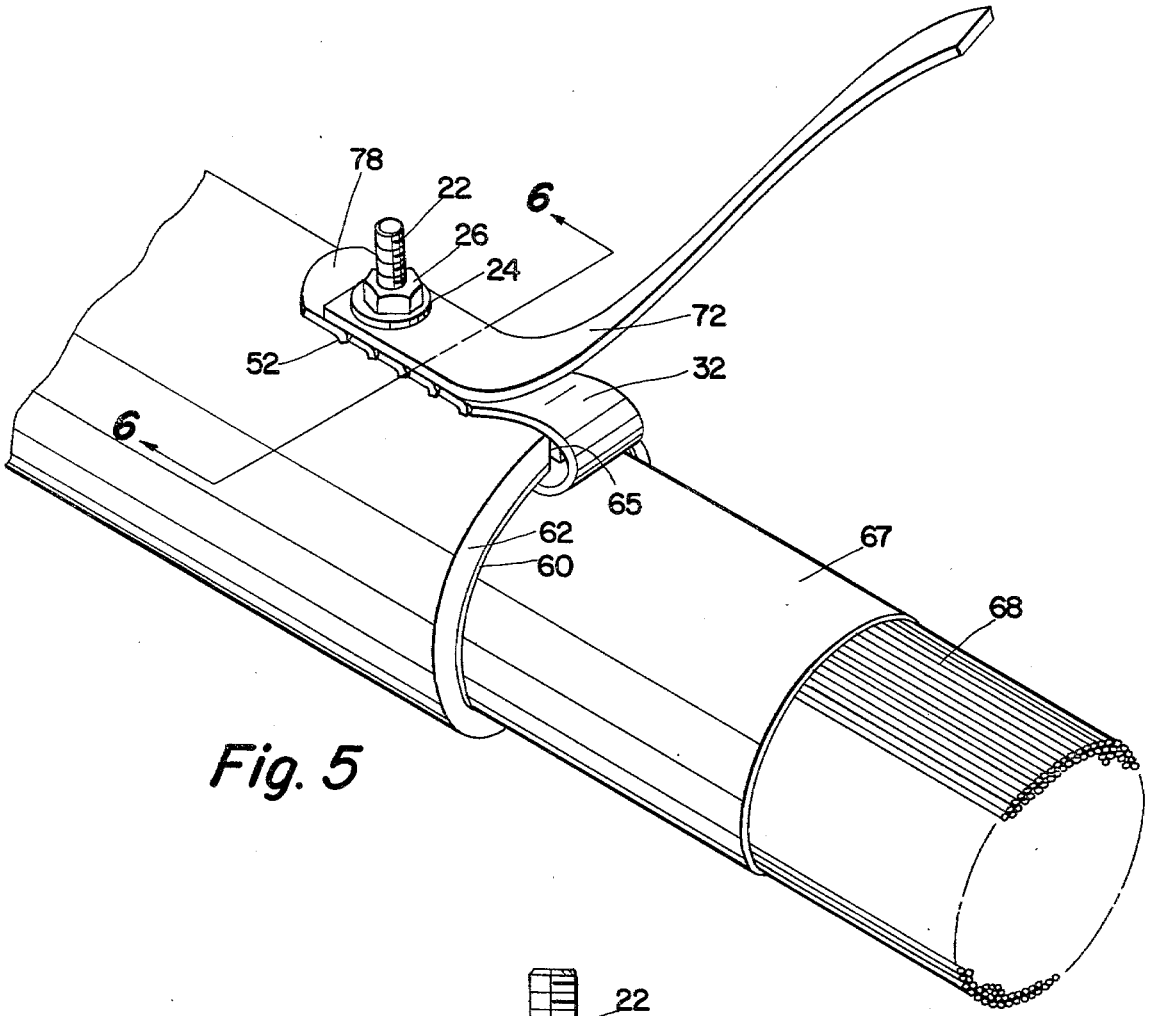
FIG. 5 is an isometric view of the connector attached to a cable sheath and bonding conductor.

Illustrated in FIGS. 1 to 6 is a preferred embodiment of a connector 10 according to the present invention. In FIG. 1 the connector 10 is shown as assembled. It is comprised of a generally V-shaped strip of elastically resilient conductive material having a U-shaped loop 14 (see FIG. 2) which functions primarily as a hinge, and joining means of a stud 22, washer 24 and nut 26. FIG. 4 shows a side view as assembled. It will be readily seen by those skilled in the art that the connector might comprise two separate members movably joined to each other, and any other suitable joining means.

In addition to the longitudinal curvarture forming the V and U shapes, the strip also has transverse curvature except in portions of the loop 14. The strip is composed of any of various copper alloys, of springlike quality, known to those skilled in the art and used for similar purposes. Preferably, all connector parts are tin plated.

The connector may be seen disassembled in FIGS. 2 and 3. It has an upper arm 32 with a transversely concave inner surface, a lower arm 36 with a transversely convex inner surface, and a stud 22 projecting from the lower arm near its end opposite the loop 14. The upper arm 32 has an oblong hole 42 through which the stud 22 projects when arms 32 and 36 are pulled together. The loop 14 has only longitudinal curvature except in the transition region 15 joining loop 14 and arms 32 and 36, where adjacent to loop 14 the longitudinal curvature is joined with transverse curvature.

The inner convex surface 76 of arm 36 is preferably embossed to create sharp raised edges and points which act as supplementary shield contacts.

The transverse curvature of arms 32 and 36 is preferably approximately equal to that of the cable shield. This curvature makes said arms relatively longitudinally unbending compared to the loop 14 which thereby functions as a hinge or pivot. Arms 32 and 36 have edge barbs or tangs 52 and 56 respectively, on each longitudinal edge, projecting inwardly an amount comparable to the typical cable sheath thickness. Corresponding barbs 52 and 56 of the arms 32 and 36 respectively are longitudinally positioned along the strip edges to be in longitudinal alignment when the joinable ends are joined, as illustrated in FIG. 4.

Figure 6:
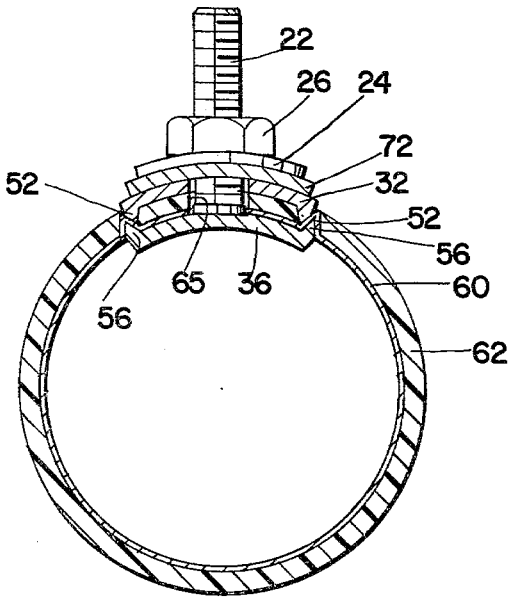
FIG. 6 is an end view of a cross-section of the connector, cable sheath and bonding conductor, taken along a plane normal to the axis of the cable sheath and passing through line 6—6 of FIG. 5.

FIGS. 5 and 6 show a connector according to the present invention mounted on a cable sheath comprised of jacket 62 and shield 60, with a flexible braid bonding conductor 72 mounted between the upper arm 32 and the washer 24. The stud 22 has been inserted in a linear slit 65 in the end of sheath 60, 62. The slit 65, shown in FIG. 6, is expanded around stud 22, extending from there, longitudinally parallel to the cable axis, to the cut end of the sheath 60, 62. It allows arm 36 to be inserted under the sheath 60, 62.

The slit 65 provides the clearance needed for the entry of arm 36. This reduces abrasion and strain on the core covering 67 and core conductors 68, shown in FIG. 5 and omitted from FIG. 6. Only a small amount of sheath deformation is required to produce sufficient clearance.

When the connector 10 is fully engaged with the sheath 60, 62 all the edge barbs 52, 56 engage the sheath 60, 62 along each edge of the slit 65 and lock the slit edges, restoring the sheath integrity and minimizing relative motion of connector 10 and sheath 60, 62. In this manner the connector 10 re-establishes the integrity of the jacket 62 mechanically and the shield 60 electrically.

Barbs 52 and 56 are longitudinally spaced along the strip edges from the vicinity of the stud 22 and slot 42 to the beginning of loop 14. However, as best seen in FIG. 6, the transverse positioning of barbs 52 and 56 is such that the sharp tips of barbs 52 on the upper member 32 are inwardly positioned relative to the tips of barbs 56 on the lower member 36, so that when the joinable ends of arms 32 and 36 are joined, the upper barbs 52 push transversely and outwardly against the lower barbs 56 trapping the cable shield 60 in between with high contact force.

Because of the transverse curvature of the arms 32 and 36, a curvature which generally conforms to the shield 60 curvature, any deformation of arms 32 and 36 due to more forceful joining of the joining means 22, 24, 26 causes barbs 52 to tend to move transversely outwardly and barbs 56 to tend to move transversely inwardly thereby increasing wedging contact force between barbs 52 and 56 and shield 60.

Comparing FIG. 2 with FIG. 4 it can be seen that the applied connector 10, which would have the configuration shown in FIG. 4, is deformed elastically so that the mid portions between loop 14 and joining means 22, 24, 26 are sprung outwardly from their undistorted positions and the loop 14 is in tension as is the stud 22. Thus the total clamping force is approximately equal to the sum of the tension in the stud 22 and the tension in the loop 14, or approximately twice the tension in the stud 22. This greater available clamping force permits increasing the contact area between connector 10 and shield 60 while still attaining a higher than usual contact force. This produces a lower initial bond resistance than ordinary shield connectors provide.

Also, because of the elastically stored compression between the deformed arms 32 and 36, plastic flow of the jacket 62 is substantially compensated for by elastic maintenance of contact force between arms 32, 36 and the sheath 60, 62 in the portions of said arms adjacent to the loop 14. Thus the present connector 10 also has increased capability for maintaining low bond resistance while the cable jacket 62 ages.

Joining means 22, 24, 26 are conductive, enabling shield currents to be better conducted to the bonding conductor attached to the stud 22, by the nut 26 and washer 24. The washer is preferably generally conforming in shape to arm 32 so that if the bonding conductor is flat braided cable 72 it may be positioned over the stud 22, between arm 32 and washer 24 for lowest contact resistance between bonding conductor 72 and connector 10. Other bonding conductors such as bar or wire with a lug may be placed over the stud 22, between washer 24 and nut 26, if desired. Alternatively, bonding conductors may be conductively joined to arm 32 at locations other than the joining means, by any of various means well known to those skilled in the art.

Shield currents conducted by way of arm 36 have the parallel paths of stud 22 and loop 14, to reach the bonding conductor 72.

Arm 32 is preferably provided with an extension 78 to provide leverage facilitating pushing members 32 and 36 together, after arm 36 has been inserted under the sheath 60, 62.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and the scope of the invention as hereinafter claimed.

What is claimed is:

1. A connector for joining the shield of a cable having a tubular cable sheath including an inner shield and an outer jacket, to a conductor, said connector comprising:

a longitudinal inner member having a first and second end, said inner member being electrically conductive, and substantially all of said inner member being located inside said cable sheath adjacent to and conductively contacting said shield, whereby shield currents are conducted to said inner member, a longitudinal outer member having a first and a second end, said outer member being located outside said cable sheath adjacent to said outer jacket and in longitudinal alignment with said inner member, at least one of said inner and outer members being elastic and presenting a longitudinally convex curvature toward the other member, first joining means joining said first end of said inner member to said first end of said outer member, second joining means joining said second end of said inner member to said second end of said outer member, said cable sheath being compressed by the action of said first and said second joining means between said inner and said outer members, and contact means electrically connecting said inner member to said conductor.

2. The connector as set forth in claim 1 and wherein said second joining means is electrically conductive, and is conductively connected to said conductor and to said inner member.

3. The connector as set forth in claim 1, and wherein said outer member and said first joining means are electrically conductive, said first joining means is conductively connected to said inner member and to said outer member, and said conductor is conductively connected to said outer member.

4. The connector as set forth in claim 1, and wherein said outer member and said second joining means are electrically conductive, said second joining means is conductively connected to said inner member and to said outer member, and said conductor is conductively connected to said outer member.

5. The connector as set forth in claim 1, and wherein at least one of the ends of said outer member is provided with a longitudinally extended tab portion.

6. The connector as set forth in claim 1, and wherein said first joining means is electrically conductive, and is conductively connected to said conductor and to said inner member.

7. The connector as set forth in claim 6, and wherein said second joining means is a hinge means.

8. The connector as set forth in claim 1, and wherein said second joining means is a hinge means.

9. The connector as set forth in claim 1 or claim 8 and wherein each of said inner and outer members has at least one pair of pointed tangs projecting therefrom, each tang on each said member projecting toward the other said member and being opposed by a corresponding one of said tangs on said other said member, said pair or pairs on said inner member being spaced slightly farther apart than said pair or pairs on said outer member, such that because said cable sheath is compressed between said inner and outer members, said cable sheath is wedged between the inside surfaces of the lower tangs and the outside surfaces of the upper tangs, and wherein said inner member presents a transversely convex curvature toward said outer member, said outer member presents a transversely concave curvature toward said inner member, and at least one of said inner and outer members is elastic.

10. The connector as set forth in claim 9, and wherein said pair or pairs of tangs are transversely spaced, are more than one in number upon each of said inner and outer members, and form two rows of tangs on each said member, said rows lying along the longitudinal edges of said members.

11. The connector as set forth in claim 1 or claim 8, and wherein said inner member has a surface adjacent to said shield, and said surface is embossed to form sharp raised edges and points.

12. The connector as set forth in claim 8, and wherein said first end of said outer member is provided with a longitudinally extended tab portion.

13. A connector for joining the shield of a cable having a tubular cable sheath including an inner shield and an outer jacket, to a conductor, said connector comprising:

a longitudinal member having an inner and an outer arm, each said arm having an end, said arms being joined by and integral with an intermediate bent portion of greater elasticity than said arms, said bent portion tending to urge said arms apart but being sufficiently elastic to permit said arms to be brought together by moderate force, said member being electrically conductive, substantially all of said inner arm being located inside said cable sheath adjacent to and conductively contacting said shield, whereby shield currents are conducted to said inner arm, said outer arm being located outside said cable sheath adjacent to said outer jacket and in longitudinal alignment with said inner arm, joining means for joining said ends of said arms, at least one of said inner and outer arms being elastic and having between said joining means when said arms are not joined, a portion which is longitudinally convexly curved toward the other said arm, such that when said arms are joined the curved portion of the first said arm is deflected elastically outward to provide a compressive force between said arms intermediate said bent portion and said ends, which is greater than that exerted at said ends by said joining means, and contact means electrically connecting said longitudinal member to said conductor.

14. The connector as set forth in claim 13, and wherein said joining means is electrically conductive, and said joining means is conductively connected to said conductor and to said inner arm, said contact means thus comprising said joining means.

15. The connedctor as set forth in claim 13, and wherein said inner arm presents a transversely convex curvature toward said outer arm and said outer arm presents a transversely concave curvature toward said inner arm, each of said inner and outer arms bears a plurality of pairs of pointed tangs projecting therefrom, each tang on each said arm projecting toward the other said arm and being opposed by a corresponding one of said tangs on said other said arm, said pairs of tangs forming two rows of tangs on each said arm, one tang from each pair being in each said row, said two rows on said inner arm being spaced slightly farther apart than said two rows on said outer arm and said rows lying along the longitudinal edges of said arms, said end of said outer arm is provided with a longitudinally extended tab portion, and said inner arm has a surface adjacent to said shield, and said surface is embossed to form sharp raised edges and points.

16. A connector for joining the shield of a cable to a conductor, said connector comprising:

a longitudinal member having an upper and a lower arm, each said arm having an end, said arms being joined by and integral with an intermediate U-shaped bent portion, said arms being aligned longitudinally, said bent portion being sufficiently elastic to permit said arms to be brought close together by moderate force, said member being electrically conductive, joining means capable of joining said ends of said arms when said ends are brought close, said joining means being electrically conductive and being conductively connected to said conductor and to said lower arm, each of said upper and lower arms bearing thereon at least one pair of pointed tangs projecting therefrom toward the other said arm, each said tang being opposed by a corresponding one of said tangs on said other of said arms; said pair on said lower arm being spaced slightly farther apart than said pair on said upper arm, at least one of said upper and lower arms being elastic, said lower arm presenting a transversely convex curvature toward said upper arm and said upper arm presenting a transversely concave curvature toward said lower arm, and at least one of said upper and lower arms presenting a longitudinally convex curvature toward the other said arm, such that when said ends of said arms are brought close, at least one of said arms is outwardly deflected, providing a springlike force tending to press said arms together intermediate said bent portion and said ends.

17. The connector of claim 16 and wherein each of said upper and lower arms has more than one said pair of pointed tangs, and said pairs of tangs form two rows of tangs on each said arm, one tang from each pair being in each said row, and each said row lying along a longitudinal edge of one of said arms.

18. The connector of claim 16 and wherein said end of said upper arm is provided with a longitudinally extended tab portion, and said lower arm has an upper surface which is embossed to form sharp raised edges and points.

19. A connector for joining the shield of a cable to a conductor, said connector comprising:

a longitudinal member having an upper and a lower arm, each said arm having an end, said arms being joined by and integral with an intermediate U-shaped bent portion, said arms being aligned longitudinally, said bent portion tending to urge said arms apart but being sufficiently elastic to permit said arms to be brought close together by moderate force, said member being electrically conductive, said lower arm presenting a transversely convex curvature toward said upper arm and said upper arm presenting a transversely concave curvature toward said lower arm, each of said upper and lower arms bearing thereon a plurality of pairs of pointed tangs projecting therefrom toward the other said arm, each pair of tangs being opposed by a corresponding pair of said tangs on said other of said arms; each said pair on said lower arm being spaced slightly farther apart than said pair on said upper arm, said pairs of tangs forming two rows of tangs on each said arm, one tang from each pair being in each said row, said two rows on said lower arm being spaced slightly farther apart than said two rows on said upper arm and said rows lying along the longitudinal edges of said arms, said end of said upper arm being provided with a longitudinally extended tab portion, joining means capable of joining said ends of said arms when said ends are brought close, said joining means being electrically conductive and being conductively connectable to said conductor and to said lower arm, and at least one of said lower and upper arms being elastic and having between said joining means, when said arms are not joined, a portion which is longitudinally convexly curved toward the other said arm, such that when said arms are joined, said longitudinally curved portion of the first said arm is deflected elastically outward to provide a compressive force between said arms intermediate said bent portion and said ends, which is greater than that exerted at said ends by said joining means.

* * * * *